US007833327B2

(12) United States Patent
Hirai et al.

(10) Patent No.: US 7,833,327 B2
(45) Date of Patent: Nov. 16, 2010

(54) THERMAL INSULATOR

(75) Inventors: Chie Hirai, Shiga (JP); Kazutaka Uekado, Hyogo (JP); Akiko Yuasa, Kyoto (JP)

(73) Assignee: Panasonic Corporation, Osaka (JP)

( * ) Notice: Subject to any disclaimer, the term of this patent is extended or adjusted under 35 U.S.C. 154(b) by 359 days.

(21) Appl. No.: 11/814,950

(22) PCT Filed: Jan. 27, 2006

(86) PCT No.: PCT/JP2006/301277

§ 371 (c)(1),
(2), (4) Date: Jul. 27, 2007

(87) PCT Pub. No.: WO2006/080416

PCT Pub. Date: Aug. 3, 2006

(65) Prior Publication Data

US 2009/0007789 A1 Jan. 8, 2009

(30) Foreign Application Priority Data

Jan. 28, 2005 (JP) ..... 2005-020734
Apr. 1, 2005 (JP) ..... 2005-105903
Dec. 16, 2005 (JP) ..... 2005-363027

(51) Int. Cl.
*B01D 53/02* (2006.01)

(52) U.S. Cl. ..... 96/153; 96/108; 428/36.1; 428/69

(58) Field of Classification Search ..... 96/108, 96/153; 428/36.1, 69
See application file for complete search history.

(56) References Cited

U.S. PATENT DOCUMENTS 3,488,469 A * 1/1970 Buss ..... 219/146.52
4,770,697 A * 9/1988 Zurecki ..... 75/681
5,885,682 A * 3/1999 Tanimoto et al. ..... 428/69
6,911,065 B2 * 6/2005 Watanabe et al. ..... 95/90
6,938,968 B2 9/2005 Tanimoto et al.

(Continued)

FOREIGN PATENT DOCUMENTS

JP 61-103090 5/1986

(Continued)

OTHER PUBLICATIONS

Translation of JP-2004-358390, Ezaka Yukio, Dec. 24, 2004.*

(Continued)

*Primary Examiner*—Robert J Hill, Jr.
*Assistant Examiner*—Christopher P Jones
(74) *Attorney, Agent, or Firm*—RatnerPrestia

(57) ABSTRACT

An adsorbent capable of adsorbing gas low in activity such as nitrogen is used, and a thermal insulator high in production efficiency and excellent in adiabatic performance is presented. A thermal insulator has an adsorbent, a core material, and an enveloping member. The adsorbent includes Li and solid matter of hardness of 5 or more. The gas adsorbing activity becomes very high, and for embodiment by evacuating to a certain degree of vacuum by using a vacuum pump, the remaining gas is adsorbed by the adsorbent of the invention to obtain a desired degree of vacuum, so that a thermal insulator of high production efficiency is obtained. Since the heat conductivity is decreased by adsorbing gas of low activity in the enveloping member, the adiabatic performance is enhanced.

15 Claims, 8 Drawing Sheets

U.S. PATENT DOCUMENTS

| | | | | |
|---|---|---|---|---|
| 2004/0173335 | A1* | 9/2004 | Schaffer et al. | 164/98 |
| 2005/0175809 | A1* | 8/2005 | Hirai et al. | 428/69 |

FOREIGN PATENT DOCUMENTS

| | | | |
|---|---|---|---|
| JP | 3252866 | | 9/1993 |
| JP | 09-512088 | | 12/1997 |
| JP | 10-253245 | | 9/1998 |
| JP | 2001-349492 | | 12/2001 |
| JP | 2004-358390 | | 12/2004 |
| KR | 2003-0011828 | A | 2/2003 |
| WO | WO 2004/110930 | | 12/2004 |

OTHER PUBLICATIONS

International Search Report for Application No. PCT/JP2006/301277 dated May 2, 2006.

* cited by examiner

THERMAL INSULATOR

THIS APPLICATION IS A U.S. NATIONAL PHASE APPLICATION OF PCT INTERNATIONAL APPLICATION PCT/JP2006/301277.

TECHNICAL FIELD

The invention relates to a thermal insulator preferably used as thermal insulator for refrigerator, warm or cold storage container, automatic vending machine, electric water heater, insulated container, automobile, train, or housing.

BACKGROUND ART

Recently, from the viewpoint of prevention of global warming, energy-saving is strongly demanded, and energy-saving is an urgent problem in electric household appliances. Especially in warm and cold storage container, a thermal insulator having an excellent adiabatic performance is required from the viewpoint of efficient use of heat.

Generally, thermal insulators include fibrous material such as glass wool, and foamed body such as urethane foam. To enhance the adiabatic performance of these thermal insulators, it is required to increase the thickness of insulator. By increasing the insulator thickness, however, the size is limited in the space to be filled, and it is difficult to save the space or utilize the space effectively.

Accordingly, a vacuum insulator is proposed as insulator of high performance. This is a thermal insulator made from a core member having a spacer function, being inserted in an enveloping member having gas barrier performance, and sealed by evacuating the inside.

By raising the degree of vacuum in the vacuum insulator, an adiabatic effect of high performance is obtained. The gas existing in the vacuum insulator is roughly classified into three types. First is a residual gas not exhausted at the time of manufacture of vacuum insulator. Second is the gas generated from the core material or enveloping member after vacuum sealing, such as gas adsorbed in core material or enveloping member, or reaction gas generated by reaction of unreacting components of core material. Third is the gas invading from outside through the enveloping member.

To adsorb these gases, the vacuum insulator may be filled with adsorbent. For example, carbon dioxide or moisture in the vacuum insulator is adsorbed by general adsorbent such as silica alumina (see, for example, Japanese Patent Application Laid-Open No. 61-103090, or cited reference 1).

The gas in the vacuum insulator is also adsorbed by Ba—Li alloy (see, for example, Japanese Patent Application National Publication No. 9-512088, or cited reference 2). Of the gases to be adsorbed by the adsorbent in the vacuum insulator, one of the most difficult gases to be adsorbed is nitrogen. This is because the nitrogen molecule is a nonpolar molecule having a large bonding energy of about 940 kJ/mol, and it is hard to activate. By using Ba—Li alloy, however, nitrogen can be adsorbed, and the degree of vacuum can be maintained within the vacuum insulator.

An oxygen absorbent is made of iron powder, oxidation promoting substance, filler, and moisture donor (see, for example, Japanese Patent No. 3252866, or cited reference 3).

This is an oxygen absorbent used in quality maintaining application of food and medicine, and moisture is needed for oxygen absorption.

In cited reference 1, gas of low activity such as nitrogen is adsorbed, and it is hard to realize. In cited reference 2, nitrogen can be adsorbed at ordinary temperature without requiring heat treatment for activation, but higher activity and larger capacity are demanded, and since Ba is a toxic substance, and sufficient safety for environment and human heath is required for industrial use. Beside, the alloy must be melted, and a huge energy is needed in manufacture. In cited reference 3, moisture is needed for oxygen absorption, and it is hard to use in an atmosphere not allowing even a trace of moisture.

DISCLOSURE OF THE INVENTION

The invention is devised to solve the problems of the prior art, and it is hence an object thereof to present a thermal insulator excellent in adiabatic performance and productivity, by obtaining an adsorbent capable of adsorbing gas of low activity such as nitrogen.

The thermal insulator of the invention includes an enveloping member, and an adsorbent capable of adsorbing gas. The adsorbent has at least Li and solid matter with hardness of 5 or more, and includes a gas adsorbing substance capable of adsorbing at least nitrogen or oxygen at 25° C. under atmospheric pressure.

Usually, Li is inactivated as a film is formed on the surface, and cannot adsorb nitrogen or oxygen.

However, by coexistence of solid matter of hardness of 5 or more, together with Li of hardness of 0.6, the solid matter crushes Li, and the Li surface is ground, and an active surface is newly generated. Therefore, nitrogen or oxygen can be promptly adsorbed at ordinary temperature.

By using such gas adsorbing substance as insulator, nitrogen, oxygen and other gases in the insulator can be adsorbed, and the productivity and adiabatic performance may be enhanced.

That is, by evacuating the enveloping member by vacuum pump to a degree of vacuum easily reachable industrially, and adsorbing the residual gas by a gas adsorbing substance, a thermal insulator can be manufactured efficiently. Such production method is particularly efficient in an insulator large in exhaust resistance and hard to evacuate.

At this time, an ordinary adsorbent cannot adsorb residual gas in the enveloping member, especially nitrogen, but such production method is possible by using this gas adsorbing substance. Moreover, because of high activity of this gas adsorbing substance, the gas can be adsorbed quickly, and the production speed is high, and the insulator can be manufactured efficiently.

Moreover, since the remaining gas not exhausted at the time of fabrication of insulator can be adsorbed, and the initial heat conductivity is decreased, and the gas invading from outside by passing through the enveloping member can be adsorbed continuously, and a long-term reliability is enhanced.

The thermal insulator of the invention includes at least an oxide as solid matter.

By using an oxide, the activity of Li tends to be maintained more sufficiently. When Li and metal are combined, Li reduces the metal which is likely to contain oxygen as impurity, and Li may deteriorate.

However, such oxidation of Li can be suppressed when Li is combined with an oxide stably containing oxygen.

When the gas adsorbing substance having such composition in the insulator, an insulator excellent in adiabatic performance both initially and in a long term can be obtained.

At least part of Li is 1 mm or less in particle size. By controlling the particle size under 1 mm, it is easier to nitride or oxidize not only in outer layer of Li but also inside of Li, and the gas adsorption amount per Li increases, and the material can be utilized effectively.

In the thermal insulator of the invention, preferably, at least Li and part of solid matter are compatible. By compatible existence of Li and part of solid matter, the interface increases, and the activity may be enhanced.

In the thermal insulator of the invention, preferably, the gas adsorbing substance is composed by mixing at least Li and solid matter by mechanical alloying.

By mechanical alloying, Li and solid matter can be crushed and mixed at high energy. As a result, the Li grinding effect by solid matter is increased, and Li freshly exposed surface and pulverizing effect are increased. Since the solid matter is also ground and pulverized, it is more effective for pulverizing Li.

By mechanically alloying, further, mechanical energy is accumulated in Li and solid matter, and the energy after mechanical alloying is larger than the energy at starting point, and a higher activity is expected.

By fabricating in this method, dissolving is not necessary and thermal energy is not used, and it is excellent from environmental and economical viewpoint.

Aside from adsorbent, the thermal insulator also includes other adsorbent capable of adsorbing moisture or oxygen.

The gas adsorbing substance of the invention can adsorb moisture or oxygen, but in order to maintain adsorbing activity of nitrogen, an atmosphere lower in content of moisture or oxygen is preferable. To maintain adsorbing activity of oxygen, an atmosphere lower in content of moisture is preferable.

It is hence preferable to use an adsorbent capable of adsorbing moisture or oxygen.

The thermal insulator of the invention further has a core material contained in a space covered with enveloping member.

Therefore, if a thin metal plate, plastic or laminate film is used as enveloping member, the inside core material functions as spacer, and it is possible to withstand atmospheric compression sufficiently. By reducing the thickness of enveloping member, heat leak propagating the enveloping member can be decreased. The core material is a permeable structure or assembly, and is composed as a porous body.

Conventionally, a thermos bottle was manufactured usually in a cylindrical shape to withstand atmospheric compression, but since the core material is used in the invention, the shape of thermal insulator is not specified, including cylindrical shape, flat plate, box, or the like.

Because of such core material, exhaust resistance at the time of evacuating increases, and it takes time in evacuating, or specified degree of vacuum may not be reached. However, by using the gas adsorbing substance of high activity as in the invention, the residual nitrogen or oxygen may be adsorbed. For example, by evacuating by a vacuum pump to a certain degree of vacuum, subsequently the residual gas may be adsorbed by the adsorbent of the invention, and a specified degree of vacuum is obtained, so that the production efficiency of thermal insulator is enhanced.

In the thermal insulator of the invention, the enveloping member is a box containing metal. The thermal insulator having such structure is generally, different from the flat thermal insulator, difficult to compress uniformly in the box space having plural planes. It is particularly hard to compress uniformly in the box shorter in the distance between walls.

However, by using the gas adsorbing substance of high activity of the invention, the residual nitrogen can be adsorbed, and the gas in the box can be adsorbed to be compressed uniformly, and a box-shaped thermal insulator high in adiabatic performance and high in production efficiency can be obtained.

The thermal insulator of the invention can adsorb nitrogen, oxygen, hydrogen, carbon dioxide, carbon monoxide, moisture and other gases in the insulator, in particular nitrogen and oxygen, and the adiabatic performance is enhanced. That is, since the residual gas not exhausted during manufacture of insulator can be adsorbed, the initial heat conductivity is decreased, and the gas invading from outside by passing through the enveloping member can be adsorbed continuously, and a long-term reliability is enhanced.

For example, by evacuating by a vacuum pump to a certain degree of vacuum, subsequently the residual gas may be adsorbed by the adsorbent of the invention, and a specified degree of vacuum is obtained, so that the production efficiency of thermal insulator is enhanced.

Other thermal insulator of the invention includes at least an enveloping member, and an adsorbent capable of adsorbing gas, in which the adsorbent includes a gas adsorbing alloy made of at least two metals not forming an intermetallic compound at least mutually, and the enthalpy of mixture of two metals is greater than 0.

Among metals not forming an intermetallic compound mutually, and having the enthalpy of mixture of two metals of greater than 0, usually, metals not having interaction each other are used. Accordingly, the activity of the contained metals can be enhanced. As a result, the reactivity of metal and gas is enhanced, and the gas adsorbing activity becomes higher.

The reason is estimated as follows: schematically, for example, in Li—Fe system alloy, Li atom and Fe atom do not form stable chemical bond, and when these two atoms are joined by force, these elements are reinforced in the function to bond with a third element, and the adsorbing activity is enhanced.

By using such gas adsorbing alloy in the insulator, nitrogen and other gas in the insulator can be adsorbed, and the productivity and adiabatic performance may be enhanced.

That is, by evacuating the enveloping member by vacuum pump to a degree of vacuum easily reachable industrially, and adsorbing the residual gas by a gas adsorbing alloy, a thermal insulator can be manufactured efficiently. Such production method is particularly efficient and effective in an insulator large in exhaust resistance and hard to evacuate.

At this time, an ordinary adsorbent cannot adsorb residual gas in the enveloping member, especially nitrogen, but such production method is possible by using this gas adsorbing alloy. Moreover, because of high activity, the gas can be adsorbed quickly, and the production speed is high, and the insulator can be manufactured efficiently.

Moreover, since the remaining gas not exhausted at the time of fabrication of insulator can be adsorbed, and the initial heat conductivity is decreased, and the gas invading from outside by passing through the enveloping member can be adsorbed continuously, and a long-term reliability is enhanced.

Between two metals, by mixing so as to cause compatibility in part, the repulsive force between metals is further heightened, and the activity of the contained metals is enhanced. Therefore, the reactivity of gas is enhanced, and the gas adsorbing activity becomes higher, and the initial heat conductivity is decreased, the long-term reliability is enhanced, and the adiabatic performance is improved.

The thermal insulator of the invention is at least made of Li and a transition metal not forming an intermetallic compound with Li, and having the enthalpy of mixture of two metals of greater than 0.

Accordingly, the activity of Li capable of adsorbing nitrogen can be enhanced. As a result, the obtained alloy is very high in gas adsorbing activity on nitrogen which is very hard to adsorb.

To obtain such alloy, metals are mixed by mechanical alloying.

In the thermal insulator of the invention, mixing by mechanical alloying is an optimum method for enhancing the activity by alloying two metals not forming intermetallic compound mutually and having the enthalpy of the mixture of greater than 0.

The adsorbent includes gas adsorbing substance and gas adsorbing alloy.

Thus, by combining gas adsorbing substance and gas adsorbing alloy having different gas adsorbing activities, right after exposure to the gas to be adsorbed, the more active substance quickly adsorbs the gas, and the less active substance adsorbs slowly, and thus the gas adsorbent excellent in both quick effect and long lasting effect can be obtained. Hence, a thermal insulator excellent in productivity and adiabatic performance can be obtained.

The thermal insulator of the invention is characterized by including, together with the gas adsorbing alloy, an adsorbent capable of adsorbing moisture or oxygen, aside from the gas adsorbing alloy.

The gas adsorbing alloy of the invention can adsorb moisture or oxygen, but in order to maintain adsorbing activity of nitrogen, an atmosphere lower in content of moisture or oxygen is preferable. Therefore, to adsorb nitrogen, it is preferred to use an adsorbent capable of adsorbing moisture or oxygen.

In the thermal insulator of the invention, the space covered with enveloping member is filled with core material made of porous substance.

Therefore, if a thin metal plate, plastic or laminate film is used as enveloping member, the inside core material functions as spacer, and it is possible to withstand atmospheric compression sufficiently. Hence, the thermal insulator can decrease the heat leak propagating the enveloping member.

Conventionally, a thermos bottle was manufactured usually in a cylindrical shape to withstand atmospheric compression. But since the core material is used in the invention, the shape of thermal insulator is not specified, including cylindrical shape, flat plate, box, or the like.

Because of such core material, exhaust resistance at the time of evacuating increases, and it takes time in evacuating, or specified degree of vacuum may not be reached. However, by using the gas adsorbing substance of high activity as in the invention, the residual nitrogen or oxygen may be adsorbed, and for example, by evacuating by a vacuum pump to a certain degree of vacuum, subsequently the residual gas may be adsorbed by the adsorbent of the invention, and a specified degree of vacuum is obtained, so that the production efficiency of thermal insulator is enhanced.

The enveloping member of the thermal insulator of the invention is a box containing metal. The thermal insulator having such structure is generally, different from the flat thermal insulator, difficult to compress uniformly in the box space having plural planes. It is particularly hard to compress uniformly in the box shorter in the distance between walls, particularly if the thickness is less than 30 mm.

However, by using the gas adsorbing alloy of high activity of the invention, the residual nitrogen can be adsorbed, and the gas in the box can be adsorbed to be compressed uniformly, and a box-shaped thermal insulator high in adiabatic performance and high in production efficiency can be obtained.

The invention also applies to a freezing or refrigerating apparatus or cold-heat apparatus having a thermal insulator of the invention disposed in a space formed by the inner box and outer box, and having other space than the thermal insulator filled with a foamed thermal insulator.

By disposing the thermal insulator of the invention excellent in adiabatic performance in the space formed of inner box and outer box, and filling other space with foamed thermal insulator, the freezing or refrigerating apparatus or cold-heat apparatus excellent in adiabatic performance can be obtained.

The thermal insulator of the invention is composed of two metals not forming intermetallic compound mutually, the enthalpy of mixture of two metals is greater than 0, and compatibility occurs at least in part, and hence it is possible to adsorb nitrogen, oxygen, hydrogen, carbon dioxide, carbon monoxide, moisture or other gas in the thermal insulator, in particular nitrogen or other gas, and the adiabatic performance is enhanced.

That is, the residual gas not exhausted at the time of manufacture of vacuum insulator can be adsorbed, and the initial heat conductivity is decreased, and the gas invading from outside by passing through the enveloping member can be adsorbed continuously, so that a long-term reliability may be enhanced.

Further, by evacuating by a vacuum pump to a certain degree of vacuum, subsequently the residual gas may be adsorbed by the adsorbent of the invention, and a specified degree of vacuum is obtained, so that the production efficiency of thermal insulator is enhanced.

DESCRIPTION OF REFERENCE NUMERALS

Figure 1:
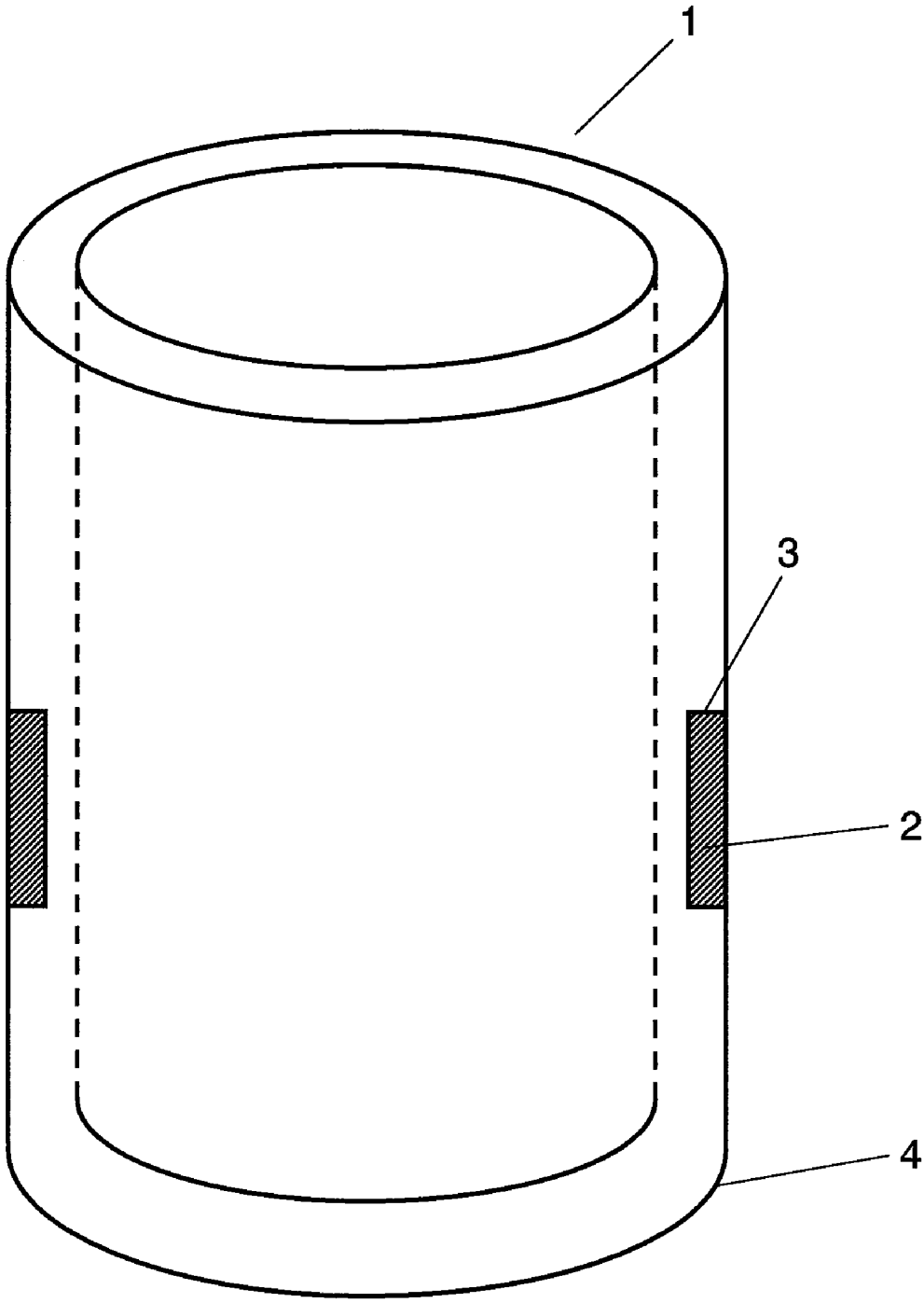
FIG. 1 is a perspective view of an example of thermal insulator in preferred embodiment 1, 2 or 3 of the invention.

1, 5, 13, 14, 15 Thermal insulator
2, 2A Gas adsorbing substance
3, 11 Container
4 Enveloping member
6, 6A, 6B, 6C, 6D Adsorbent
7 Core material
8 Enveloping member
9 Bag
10 Moisture adsorbent
12 Filling bag
16 Box
17 Refrigerator
18 Adiabatic box

19 Outer box
20 Inner box
21 Rigid urethane foam
22 Evaporator
23 Compressor
24 Condenser
25 Capillary tube
26 Door

DETAILED DESCRIPTION OF THE PREFERRED EMBODIMENTS

Preferred Embodiment 1

The thermal insulator of the invention has an enveloping member, and an adsorbent capable of adsorbing gas. The adsorbent has at least LI and solid matter with hardness of 5 or more, and includes a gas adsorbing substance for adsorbing nitrogen or oxygen at 25° C. under atmospheric pressure. The solid matter with hardness of 5 or more includes Si, B, c-C (diamond), $SiO_2$, SiC, c-BN (cubic boron nitride), $Al_2O_3$, MgO, and $TiO_2$. Other components may be also added. Herein, the hardness refers to the Morse harness of 10 stages.

The solid matter can be identified by X-ray diffraction method to check the peaks of Li and solid matter, but may be identified by other method.

The content of the solid matter is preferably 5 mol % or more to 95 mol % or less. In 100 mol % of gas adsorbing substance, if the content of solid matter is less than 5 mol %, the content of ductile Li increases, and it is hard to mix uniformly with solid matter. If the content is more than 95 mol %, the content of highly active Li decreases, and the gas adsorbing activity declines.

From the viewpoint of density, the density of the solid matter is preferably 4 g/cm$^3$ or less. The solid matter with hardness of 5 or more includes particles of which density is in a range of 4 to 5 g/cm$^3$. From the both aspects of hardness and density, to satisfy the condition of solid matter of the invention, preferably, the density should be defined at 5 g/cm$^3$ or less.

By using the solid matter satisfying such condition, if combined with Li with density of 0.53 g/cm$^3$ or more, elevation of density is slight, and the nitrogen adsorbing amount per unit weight can be increased. Therefore, when this gas adsorbing substance is assembled in the product, the weight increase is small, and the nitrogen adsorbing amount can be assured.

The gas adsorbing substance of the invention is capable of adsorbing nitrogen or oxygen at 25° C. under atmospheric pressure. It may also adsorb other gas than nitrogen or oxygen, such as hydrogen, steam, carbon monoxide, carbon dioxide, nitrogen oxide, sulfur oxide, or hydrocarbon. Other gases to be adsorbed than nitrogen or oxygen are not particularly specified.

In the invention, the measuring method of adsorbing amount includes adsorption volume method, weight method, and other known method. At least, adsorption of nitrogen or oxygen should be confirmed.

The gas adsorbing substance of the invention is capable of adsorbing nitrogen or oxygen by 1 cm$^3$ or more per 1 g, preferably 3 cm$^3$ or more. More preferably, 5 cm$^3$ or more should be adsorbed. To measure the adsorbing amount, for example, the gas adsorbing substance adsorbing in part in the adsorbing process is taken out, and the adsorbed amount of nitrogen is measured in this gas adsorbing substance. Or the gas adsorbing substance adsorbing in part or losing adsorbing activity is heated to force out nitrogen, and from this nitrogen amount and the gas adsorbing substance after heating, the adsorbed amount of nitrogen per 1 g can be calculated. Herein, the adsorption includes both adsorption on the surface, and absorption or adsorption in the inside.

The gas adsorbing substance of the invention is capable of adsorbing at ordinary temperature or about 80° C. or less, under atmospheric pressure, or particularly in low pressure region. The gas adsorbing substance can be used in various forms, such as powder, compressed formed body, pellets, sheet, thin film, or transfer to other container, or evaporation to other substance, but the forms of use are not particularly specified.

The enveloping member includes metal, plastic, glass container, plastic film, film of metal, inorganic matter, oxide or carbon evaporated to plastic, laminate pouch of laminate film having metal foil, or their combinations.

The thermal insulator evacuates the enveloping member by inserting the gas adsorbing substance in the enveloping member, and closes the enveloping member, and creates a vacuum adiabatic space. The degree of vacuum in the enveloping member is maintained by the gas adsorbing substance, or the enveloping member is evacuated to a degree of vacuum easily reachable industrially, and then the enveloping member is closed, and the gas remaining in the enveloping member is adsorbed by the gas absorbing substance. By such two-step evacuation, or by enclosing the gas adsorbing substance in other container, and evacuating the enveloping member to a specified pressure, the gas adsorbing substance communicates with the inside of the enveloping member by certain method. Two-step evacuation may be applied while keeping the gas adsorbing substance at high activity. Methods of use are not particularly specified.

At this time, by the function of two-step evaluation, especially in the latter case, after evacuating to specified degree, the gas adsorbing substance may be brought into contact with the inside of the enveloping member by some method or other. For example, after reaching a specified pressure, a certain external physical stimulation is applied, and a ventilation hole is provided in the container enclosing the gas adsorbing substance to communicate with the inside of the enveloping member, or the gas adsorbing substance is contained in container or bag together with Ar or the like, and the container or bag is disposed in enveloping member, and evacuated, and part of the container or bag swollen by pressure difference by evacuation is torn, and an opening is formed, but the method is not particularly specified.

In the thermal insulator of the invention, the solid matter contains at least an oxide. The oxide includes $Al_2O_3$, MgO, $SiO_2$, and $TiO_2$. The oxide may have three or more elements.

At least part of Li is 1 mm or less in particle size. The particle size of 1 mm or less is satisfactory if the particle size is 1 mm or less at least in part. It can be measured by general checking method. The particle size is not specified if before adsorption of gas or after adsorption.

At least Li and at least part of solid matter are compatible. Being compatible at least in part means that at least part is placed in a state not allowed to be separated into two substances physically. For example, at least in part of boundary surface of two substances, the substances are mutually bonded at atomic level, but this is not particularly specified.

At least the Li and solid matter are mixed by mechanical alloying. Mixing by mechanical alloying means a mechanical mixing method. To manufacture a gas adsorbing substance of high activity, it is preferred to perform mechanical alloying in inert gas, for example, Ar or He atmosphere, or in vacuum. At the time of mechanical alloying, sticking to the container may be prevented by adding (C), by cooling, or dropping a small amount of alcohol.

Further, in the thermal insulator, the adsorbent includes a gas adsorbing alloy made of at least two metals not forming an intermetallic compound at least mutually, and having the enthalpy of mixture of two metals of greater than 0. Two metals not forming an intermetallic compound can be confirmed, for example, by X-ray diffraction. The enthalpy of the mixture of greater than 0 is confirmed, for example, by phase diagram. The phase diagram of metal types having the enthalpy of the mixture of greater than 0 includes the phase diagram showing non-solid solution type or eutectic type.

An alloy is a substance composed of two or more metals. Both the gas adsorbing alloy and the gas adsorbing substance can be contained, for example, by mixing the former and the latter simultaneously, by preparing the gas adsorbing alloy and the gas adsorbing substance separately and using in the same atmosphere, or by preparing separately and mixing later. Alternatively, the mixture of the two is compressed and formed, or the two materials are pelletized separately, and used in same atmosphere. Or either one of the former and the latter is covered with the other.

The thermal insulator of the invention includes, together with the insulator gas adsorbing substance or gas adsorbent, an adsorbent capable of adsorbing moisture or oxygen aside from the adsorbent.

The adsorbent capable of adsorbing moisture or oxygen includes, for example, calcium oxide, magnesium oxide, strontium oxide, barium oxide, zeolite, silica gel, unsaturated fatty acid, iron, and iron compound. They may be used either alone or in combination of two or more types.

When the adsorbent capable of adsorbing moisture or oxygen is used together with gas adsorbing substance, they are used separately or mixed in the space of the enveloping member, and powder or formed body is disposed, or they are used separately or mixed in a permeable container. These adsorbents capable of adsorbing moisture or oxygen may be used simultaneously.

The thermal insulator covers at least one side of formed adsorbent with an adsorbent capable of adsorbing moisture or oxygen. The formed gas adsorbing substance is a gas adsorbing substance formed by compressing, tableting, pelletizing, or forming in other container and compressing. At least one side is covered with an adsorbent capable of adsorbing moisture or oxygen, or at least one side, plural sides, or all sides may be covered.

In such configuration, moisture is adsorbed by general adsorbent, and more stubborn gas is adsorbed by gas adsorbing substance, so that the gases may be adsorbed efficiently.

The thermal insulator has a core material contained in a space covered with the enveloping member. The core material is a permeable structure or assembly, and is composed as a porous substance in a wide sense of meaning.

The core material made of porous substance is fiber, powder, foamed resin, thin film laminated body, or their mixture. The effect is doubled by using a fibrous core material likely to be worsened in heat conductivity by gas, and a gas adsorbing substance.

The thermal insulator is an insulator of which enveloping member is a box containing metal. The box containing metal is a box of stainless steel, iron, or aluminum, or a plastic box evaporated with metal, or a plastic box having a metal foil, and they are used at least in part. They may be combined and used, or a box may be formed by using a plurality of plates. The box is not limited to box shape, but includes irregular shape, package form, and other outer shapes.

In the method of use of thermal insulator, having inner box and outer box, the insulator is disposed in a space formed by the inner box and outer box, and the space other than the insulator is filled with foamed insulator and used as a box.

For example, when applied in a refrigerator, the insulator is adhered to the outer box side or inner box side of the space between the outer box and inner box of the refrigerator, and other space is filled with resin foamed body, or the insulator integrally foaming the vacuum insulator and foamed insulator is disposed in the space between the outer box and inner box, or used similarly in the door, or used in the partition, and nothing particular is specified.

The insulator can be used in refrigerating apparatus, cool and warm apparatus, cold storage vehicle, and refrigerator utilizing electronic cooling. It is also usable in automatic vending machine, and cool and warm devices using warm and cool heat up to high temperature range. The application also usable includes gas appliance, heat reserve or cold reserve container, cooler box, and other devices not requiring power.

Further, the thermal insulator of the invention can be further applied in personal computer, jar pot, rice cooker, and automotive engine in hot insulating, heat reserving and enveloping members, and in a higher temperature region for the purposes of hot insulation, heat reserving, and adiabatic use.

When used in refrigerating and freezing apparatuses, the gas adsorbing substances may be disposed near the compressor or defrosting heater.

Not limited to thermal insulator, the substance may be used as structure for reducing pressure, or removing nitrogen or oxygen. Kept in evacuated state, for example, it may be used as display for rejecting specific substance, such as PDP, SED, organic EL, CRT, etc.

A specific thermal insulator in preferred embodiment 1 of the invention is described below by referring to the accompanying drawing.

In FIG. 1, a thermal insulator 1 includes a gas adsorbing substance 2, a container 3 for accommodating the gas adsorbing substance 2, and an enveloping member 4 composed of double cylindrical containers of gas adsorbing substance 2 and a metal for covering the container 3, and the inside of the enveloping member 4 (the space between double cylindrical containers) is evacuated.

The gas adsorbing substance 2 is contained in the container 3, and the enveloping member 4 is composed of metal double cylindrical containers, and the space between the cylindrical containers is evacuated.

In preferred embodiment 1, the gas adsorbing substance 2 is composed of Li and $Al_2O_3$. That is, 1 mol of Li and 1.1 mol of $Al_3O_3$ were mixed in Ar atmosphere by mechanical alloying, using a planet ball mill of stainless steel balls, and gas adsorbing substance (Li—$Al_2O_3$) was obtained.

To measure the adsorbing amount of the gas adsorbing substance, the nitrogen and oxygen adsorbing amounts of gas adsorbing substance (Li—$Al_2O_3$) were evaluated by using Autosorb-1-C manufactured by Quantachrome.

By evaluating the nitrogen adsorbing amount, the adsorbing capacity was confirmed to be 21.98 $cm^3$/g STP at atmospheric pressure of about 5300 Pa, and 30.45 $cm^3$/g STP at about 92000 Pa. By evaluating the oxygen adsorbing amount, the adsorbing capacity was confirmed to be 1.99 $cm^3$/g STP at atmospheric pressure of about 900 Pa, and 6.31 $cm^3$/g STP at about 92000 Pa.

The gas adsorption in thermal insulator 1 was evaluated. In evaluation operation, the gas adsorbing substance contained in a closed container 3 was slowly placed in the enveloping member 4 of cylindrical container, and the enveloping member 4 was evacuated to about 1 kPa. The closed container 3 packing the gas adsorbing substance 2 was allowed to be permeable, and the residual gas in the enveloping member 4 was adsorbed. Pressure changes in the enveloping member were measured, and the atmospheric pressure changed from 1 kPa to 15 Pa. The change of atmospheric pressure from 1 kPa to 15 Pa means that the gas adsorbing substance has adsorbed the residual gas.

Preferred Embodiment 2

Figure 2:
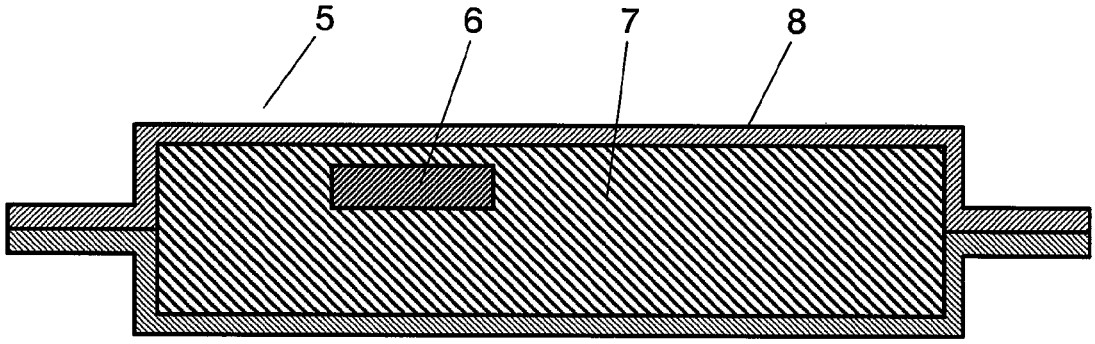
FIG. 2 is a sectional view of an example of thermal insulator in preferred embodiment 2 of the invention.

FIG. 2 is a sectional view of an example of thermal insulator in preferred embodiment 2 of the invention.

In FIG. 2, a thermal insulator 5 is composed of an adsorbent 6, a core material 7, and an enveloping member 8 covering the adsorbent 6 and core material 7, and the inside of the enveloping member 8 is evacuated.

As the gas adsorbing substance 2 to be used in the adsorbent 6, 1 mol of Li and 2 mol of MgO were mixed by mechanical alloying, using a vibration ball mill of stainless steel balls, and gas adsorbing substance (Li—MgO) was obtained.

Visually, at least part of Li was confirmed to be powder of 1 mm or less in particle size.

To measure the adsorbing amount of the gas adsorbing substance, the nitrogen and oxygen adsorbing amounts of gas adsorbing substance (Li—MgO) were evaluated by using Autosorb-1-C manufactured by Quantachrome.

By evaluating the nitrogen adsorbing amount, the adsorbing capacity was confirmed to be 5.44 $cm^3/g$ STP at about 45 Pa, and 26.64 $cm^3/g$ STP at about 92000 Pa. By evaluating the oxygen adsorbing amount, the adsorbing capacity was confirmed to be 1.94 $cm^3/g$ STP at about 45 Pa, and 11.93 $cm^3/g$ STP at about 92000 Pa.

The core material 7 was an inorganic fibrous assembly, and the enveloping member 8 was a laminate film composed of heat fusible layer, gas barrier layer, and surface protective layer.

Preferred Embodiment 3

The thermal insulator in preferred embodiment 3 of the invention includes an adsorbent capable of adsorbing gas, and a gas barrier enveloping member for covering the adsorbent. The adsorbent is a gas adsorbing alloy composed of at least two metals not forming at least intermetallic compound mutually. The enthalpy of the mixture of the two metals is greater than 0. The alloy is a substance composed of two or more metals. The two metals not forming intermetallic compound can be confirmed, for example, by X-ray diffraction.

If at least two metals do not form intermetallic compound, one or more elements can be added, and such element may form a compound with the metal.

The enthalpy of the mixture of greater than 0 can be confirmed, for example, in the phase diagram. For example, as shown in FIG. 3, if the temperature is raised somewhat, the Fe phase characteristic 38 and Li phase characteristic 40 do not intersect, and it is known that the enthalpy is greater than 0.

Figure 3:
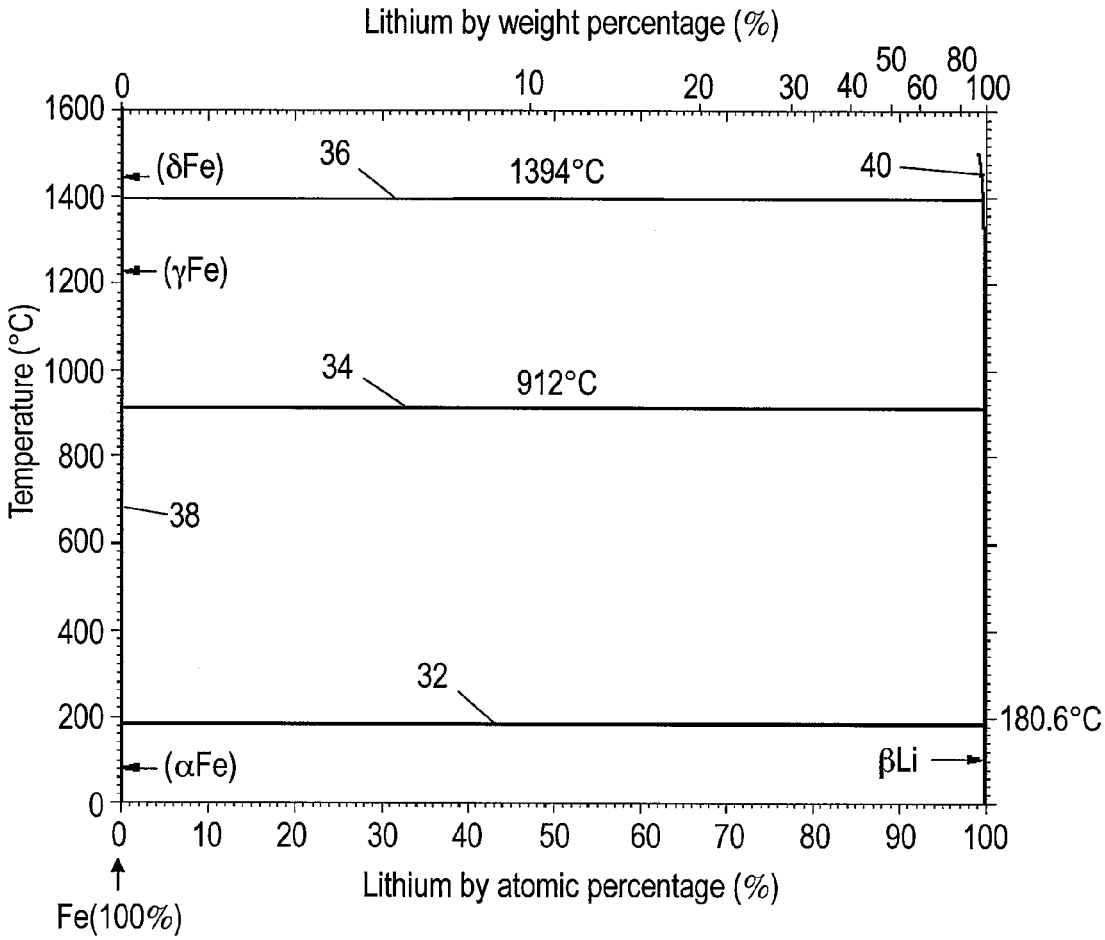
FIG. 3 is correlation diagram of Li—Fe in preferred embodiment 3 of the invention.

The phase diagram of metal types of which enthalpy of the mixture is greater than 0 includes the non-solid solvent type or eutectic type phase diagram as shown in FIG. 3.

The gases to be adsorbed include nitrogen, oxygen, hydrogen, steam, carbon monoxide, carbon dioxide, nitrogen oxide, sulfur oxide, and hydrocarbon, but are not particularly specified.

In the invention, adsorption includes both adsorption on the surface, and absorption in the inside.

Since the adsorbent in the invention is high in activity, and is capable of adsorbing at ordinary temperature, or at less than about 80° C., and at atmospheric pressure or less or in low pressure region.

Method of use of alloy includes powder, compressed form, pellet, sheet, thin film, transfer to other container, or evaporation to other substance, but is not particularly specified.

The enveloping member includes a laminate film having at least heat fusible layer, gas barrier layer, and protective layer, or metal, plastic, glass, other container, or combination of them, and anything having gas barrier property.

Such thermal insulator evacuates the enveloping member by inserting the gas adsorbing alloy in the enveloping member, and closes the enveloping member, and creates a vacuum adiabatic space, and by maintaining the degree of vacuum in the enveloping member by the gas adsorbing alloy, or evacuating the enveloping member to a degree of vacuum easily reachable industrially, the enveloping member is closed, and the gas remaining in the enveloping member is adsorbed by the gas absorbing alloy, and by such two-step evacuation, or by enclosing the gas adsorbing alloy in other container, and evacuating the enveloping member to a specified pressure, the gas adsorbing alloy communicates with the inside of the enveloping member by certain method, and the two-step evacuation may be applied while keeping the gas adsorbing alloy at high activity, but the methods of use are not particularly specified.

The thermal insulator also includes an adsorbent capable of adsorbing gas, and a gas barrier enveloping member for covering the adsorbent. The adsorbent has a gas adsorbing alloy composed of at least a first metal of which nitride forming enthalpy at 298 K is smaller than 0, and a second metal not forming intermetallic compound with this metal. The enthalpy of the mixture of the two metals is greater than 0. The metal of which nitride forming enthalpy is smaller than 0 includes Li, Mg, Al, Ca, and Si.

The thermal insulator also includes an adsorbent capable of adsorbing gas, and a gas barrier enveloping member for covering the adsorbent. The adsorbent has a gas adsorbing alloy composed of at least Li, and a transition metal not forming intermetallic compound with Li. The enthalpy of the mixture of the two metals is greater than 0.

The transition metal of which enthalpy of the mixture with Li is greater than 0 includes Co, Cr, Cu, Fe, Hf, Mn, Mo, Nb, Ni, Ta, Ti, V, W, Y, and Zr.

The content of transition metal is preferred to be 5 mol % or more to 95 mol % or less. In 100 mol % of the alloy, if the transition metal is less than 5 mol %, the content of high ductile Li is increased, and it is hard to mix uniformly with transition metal. If more than 95 mol %, the content of highly ductile Li is decreased, and the gas adsorbing activity declines.

In the gas adsorbing alloy of the thermal insulator, compatibility occurs at least in part between the two metals. Compatibility occurring at least in part means that at least part is placed in a state not capable of separating the two metals physically. For example, part of the boundary portion of the two metals is mixed between the metals at atomic level.

The gas adsorbing alloy of the thermal insulator is formed by mixing at least two metal by mechanical alloying. Mixing by mechanical alloying means a mechanical mixing method. To manufacture a gas adsorbing alloy of high activity, it is preferred to perform mechanical alloying in inert gas, for example, Ar or He atmosphere.

In the thermal insulator, the nitrogen adsorbing amount of the gas adsorbing alloy is 10 $cm^3/g$ or more at ordinary temperature and ordinary pressure. Nitrogen adsorption also occurs at reduced pressure, but it is enough if 10 $cm^3/g$ or more can be adsorbed in the measuring condition of ordinary temperature around 25° C. and ordinary pressure.

The measuring method of nitrogen adsorbing amount is not particularly specified, but includes the adsorption volume method, weight method, and other known methods.

By using such gas adsorbing alloy, since the nitrogen adsorbing amount is large, the enveloping member can be first evacuated by vacuum pump to a degree of vacuum easily achieved industrially, and then the remaining gases can be adsorbed efficiently by the gas adsorbing alloy.

The thermal insulator includes, together with the gas adsorbing alloy, an adsorbent capable of adsorbing moisture or oxygen aside from the gas adsorbing alloy.

The adsorbent capable of adsorbing moisture or oxygen includes, for example, calcium oxide, magnesium oxide, strontium oxide, barium oxide, zeolite, silica gel, unsaturated fatty acid, iron, and iron compound. They may be used either alone or in combination of two or more types.

When the adsorbent capable of adsorbing moisture or oxygen is used together with gas adsorbing alloy, they are used separately or mixed in the space of the enveloping member, and powder or formed body is disposed, or they are used separately or mixed in a permeable container.

The thermal insulator covers at least one side of formed gas adsorbing alloy with an adsorbent capable of adsorbing moisture or oxygen. The formed gas adsorbing alloy is a gas adsorbing alloy formed by compressing, tableting, pelletizing, or forming in other container and compressing. At least one side is covered with an adsorbent capable of adsorbing moisture or oxygen, or at least one side, plural sides, or all sides may be covered. In such configuration, moisture is adsorbed by general adsorbent, and more stubborn gas is adsorbed by gas adsorbing alloy, so that the gases may be adsorbed efficiently.

The thermal insulator has a core material of porous substance contained in a space covered with the enveloping member, aside from the adsorbent capable of adsorbing gas. The core material of porous material is fiber, powder, foamed resin, thin film laminated body, or their mixture, and is not particularly specified, but the effect is doubled by using a fibrous core material likely to be worsened in heat conductivity by gas, and a gas adsorbing alloy.

The enveloping member of the thermal insulator is a box containing metal. The box containing metal is a box of stainless steel, iron, or aluminum, or a plastic box evaporated with metal, or a plastic box having a metal foil, and they are used as box at least in part.

Preferred embodiment 3 relates to an example of using gas adsorbing alloy as gas adsorbing substance 2. In preferred embodiment 4, too, FIG. 1 and FIG. 2 are applied. The thermal insulator 1 includes a gas adsorbing substance 2 (gas adsorbing alloy), a container 3 containing the gas adsorbing alloy 2, and an enveloping member 4 composed of double metal cylindrical containers covering the gas adsorbing substance 2 and container 3. The inside of the enveloping member 4 (the space between the double cylindrical containers) is evacuated.

A gas adsorbing alloy was used as gas adsorbing substance 2, and Li and Fe were used as metals. In Ar atmosphere, Li and Fe were mixed by mechanical alloying by using a ball mill.

From the phase diagram of Li and Fe in FIG. 3, the enthalpy of the mixture was confirmed to be greater than 0. FIG. 3 shows the phase diagram of lithium (Li) and iron (Fe). The axis of abscissas denotes the composition ratio of lithium (Li) and iron (Fe), in atomic percentage and weight percentage. The composition ratio of Fe corresponds to 100 at. % or 100 wt. % when lithium (Li) is 0. When lithium (Li) is 100 at. % or 100 wt. %, the composition ratio of Fe corresponds to 0.

The axis of ordinates in FIG. 3 represents α Fe, γ Fe, and δ Fe. They show the states of iron (Fe), representing the transition temperature of each iron. Characteristic curve 32 shows the temperature of 180.6° C. At this temperature, β Li of lithium (Li) is transformed into liquid. Characteristic curve 34 shows the temperature of 912° C., and at this temperature, α Fe is transformed to γ Fe, and characteristic curve 36 shows to γ Fe is transformed to δ Fe.

Phase characteristic 38 shows when Fe is 100%. The axis of abscissas represents nearly overlapped straight lines. Phase characteristic 40 shows when Li is 100%, and the inclination is slightly increased as the temperature is becoming higher.

Such metals usually do not show interaction if temperature is elevated. However, when mixed by mechanical alloying, they may be mixed mutually. They can be mixed mutually because, it is considered, the metals are mutually mixed at nano level in part of the boundary surface of two metals, and compatibility occurs on the boundary surface of two metals.

A thermal insulator 1 was manufactured according to preferred embodiment 4, and the gas adsorption was evaluated. In evaluation operation, the gas adsorbing substance 2 (Li—Fe alloy) contained in a closed container 3 was slowly placed in the enveloping member 4 of cylindrical container shown in FIG. 1, and the enveloping member 4 was evacuated to about 1 kPa. The closed container 3 packing the gas adsorbing alloy was allowed to be permeable, and the residual gas in the enveloping member 4 was adsorbed. Pressure changes in the enveloping member were observed, and the atmospheric pressure changed from 1 kPa to 15 Pa.

The thermal insulators in preferred embodiments 1 to 3 of the invention, and adsorbents in the prior art are explained specifically below by referring to FIG. 4 to FIG. 8.

Embodiment 1

Figure 4:
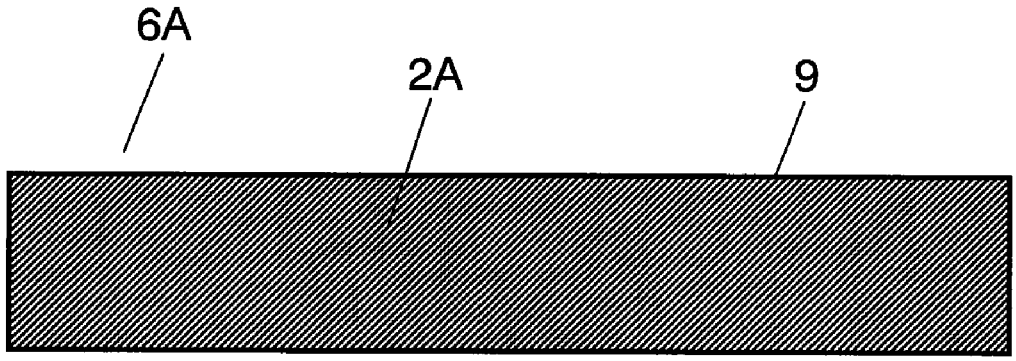
FIG. 4 is a schematic sectional view of an example of adsorbent used in thermal insulator in preferred embodiment 1, 2 or 3 of the invention.

FIG. 4 is a schematic sectional view showing an embodiment of adsorbent used in thermal insulators in preferred embodiments 1, 2 and 3 of the invention.

As adsorbent 6A, a gas adsorbing substance (gas adsorbing alloy) 2A was sealed in a permeable bag material 9. When the adsorbent 6A was disposed in the enveloping member 8, the atmospheric pressure changed from about 1 kPa to 15 Pa. The thermal insulator 5 becoming 15 Pa in atmospheric pressure was let stand for a specified time, and the remaining capability of nitrogen adsorption of the gas adsorbing substance 2A was evaluated. As a result, the adsorbent 6A was confirmed to have adsorbed nitrogen slightly.

Embodiment 2

Figure 5:
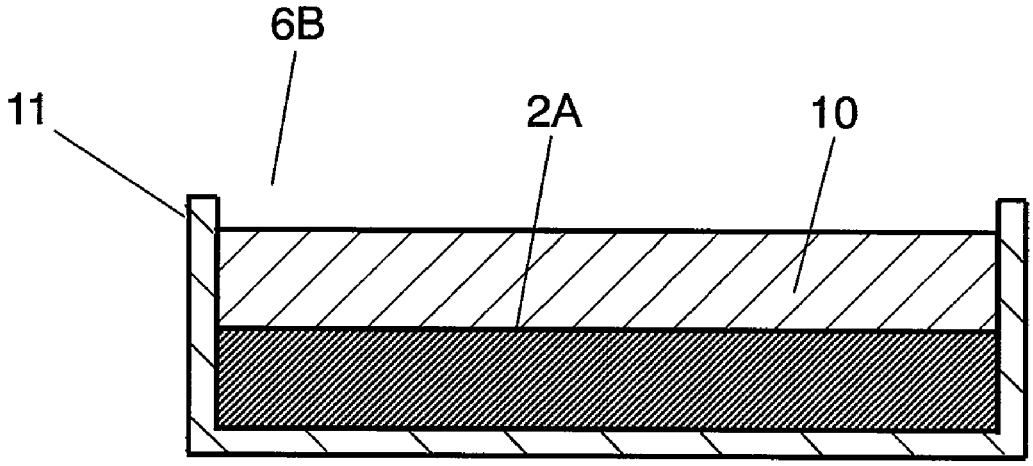
FIG. 5 is a schematic sectional view of other example of adsorbent used in thermal insulator in preferred embodiment 1, 2 or 3 of the invention.

FIG. 5 is a schematic sectional view showing other embodiment of adsorbent used in thermal insulators in preferred embodiments 1, 2 and 3 of the invention.

As adsorbent 6B, a gas adsorbing substance 2A was put in the bottom of a container 11 opened in the upside, and the top was covered with a moisture adsorbent 10 of calcium oxide, and compressed and formed.

When the adsorbent 6B was disposed in the enveloping member, the atmospheric pressure changed from about 1 kPa to 15 Pa. The thermal insulator 5 becoming 15 Pa in atmospheric pressure was let stand for a specified time, and the remaining capability of nitrogen adsorption of the gas adsorbing substance 2A was evaluated. As a result, the adsorbent 6B was confirmed to have adsorbed nitrogen.

As compared with embodiment 1, since the surrounding is covered with moisture adsorbent 10 and container 11, the moisture is adsorbed by the moisture adsorbent 10, and the load to the gas adsorbing substance 2A is considered to be lowered.

Embodiment 3

Figure 6:
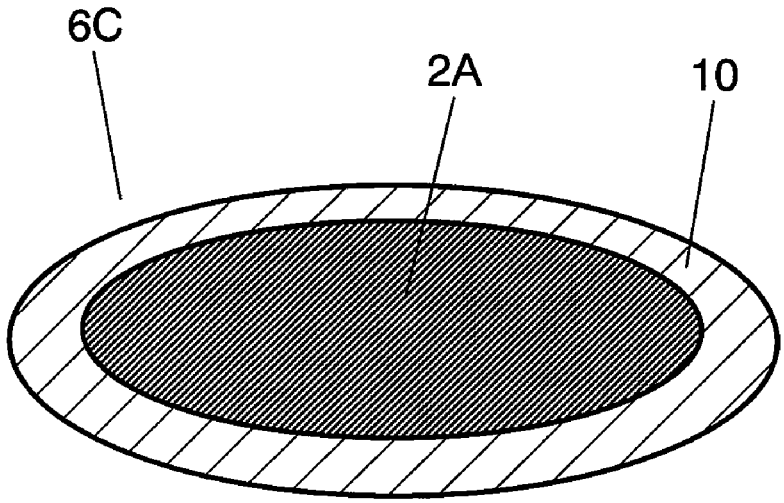
FIG. 6 is a schematic sectional view of another example of adsorbent used in thermal insulator in preferred embodiment 1, 2 or 3 of the invention.

FIG. 6 is a schematic sectional view showing another embodiment of adsorbent used in thermal insulators in preferred embodiments 1, 2 and 3 of the invention.

As adsorbent 6C, the surrounding of compressed and formed gas adsorbing substance 2A was further covered with a moisture adsorbent 10 of calcium oxide.

When the adsorbent 6C was disposed in the enveloping member 4, the atmospheric pressure changed from about 1 kPa to 15 Pa.

The thermal insulator 5 becoming 15 Pa in atmospheric pressure was let stand for a specified time, and the remaining capability of nitrogen adsorption of the gas adsorbing substance 2A was evaluated. As a result, it was confirmed to have adsorbed nitrogen.

As compared with embodiment 1, since the surrounding is covered with moisture adsorbent 10, the moisture is adsorbed by the moisture adsorbent, and the load to the gas adsorbing substance 2A is considered to be lowered.

Embodiment 4

Figure 7:
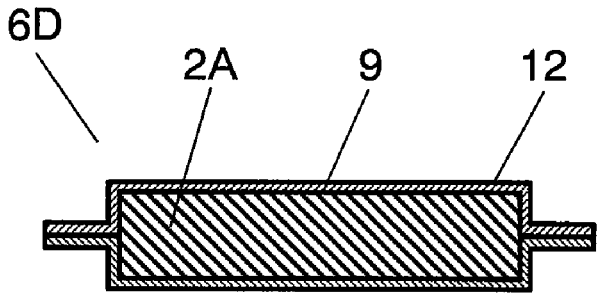
FIG. 7 is a schematic sectional view of a different example of adsorbent used in thermal insulator in preferred embodiment 1, 2 or 3 of the invention.

FIG. 7 is a schematic sectional view showing a different embodiment of adsorbent used in thermal insulators in preferred embodiments 1, 2 and 3 of the invention.

As adsorbent 6D, a gas adsorbing substance 2A was sealed in a permeable bag material 9 and inflated by pressure difference, and when the pressure difference became about 500 Pa, the heat seal was torn, and an opening was formed in a filling bag 12, in which it was sealed together with Ar gas.

At the time of fabrication of thermal insulator, a core material 7, and gas adsorbing substance 2A and bag material 9 sealed in a filling bag 12 were disposed in an enveloping member 8 having an opening, in the chamber connected to vacuum pump. The chamber was evacuated, and when the pressure difference of the chamber and filling bag 12 was about 500 Pa, the filling bag was torn to be permeable with inside of the chamber, and the sealed Ar gas was exhausted, and then the opening of the enveloping member 8 was closed by heat sealing. Then, by the effect of gas adsorbing substance 2A, the thermal insulator became 15 Pa.

The thermal insulator 5 becoming 15 Pa in atmospheric pressure was let stand for a specified time, and the remaining capability of nitrogen adsorption of the gas adsorbing substance 2A was evaluated, and adsorption of nitrogen was confirmed.

As compared with embodiment 1, it is considered because the load applied to the gas adsorbing substance 2A was lowered.

Embodiment 5

Figure 8:
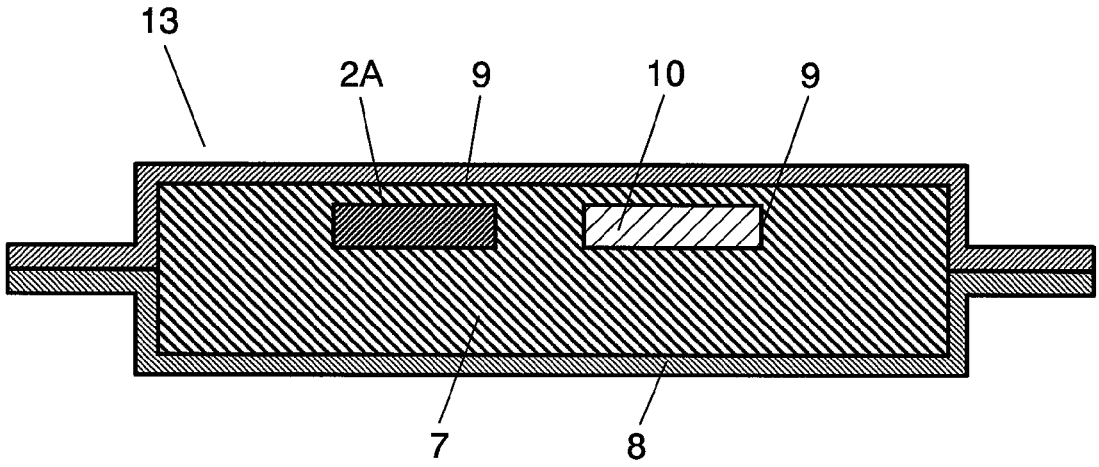
FIG. 8 is a sectional view of other example of thermal insulator in preferred embodiment 1, 2 or 3 of the invention.

FIG. 8 is a schematic sectional view showing other different embodiment of adsorbent used in thermal insulators in preferred embodiments 1, 2 and 3 of the invention.

As thermal insulator 13, separately in an enveloping member 8, a gas adsorbing substance 2A was sealed in a bag material 9, and a moisture adsorbent 10 was sealed in a bag material 9.

When these adsorbents were disposed in the enveloping member 8, the atmospheric pressure changed from about 1 kPa to 15 Pa.

The thermal insulator 13 becoming 15 Pa in atmospheric pressure was let stand for a specified time, and the remaining capability of nitrogen adsorption of the gas adsorbing substance 2A was evaluated, and adsorption of nitrogen was confirmed. As a result, the gas adsorbing substrate 2A was confirmed to have adsorbed nitrogen. However, the adsorbing amount was inferior as compared with embodiment 2 or 3. A comparative embodiment of thermal insulator of the invention is explained below. Method of evaluation is same as in embodiment 1.

Comparative Example 1

A comparative example of thermal insulator of the invention is explained. In FIG. 4, Li—Au was used as adsorbent 6A. In Ar atmosphere, Li and Au were mixed by mechanical alloying in ball mill.

When the adsorbent 6A was disposed in the enveloping member, the atmospheric pressure was hardly decreased from about 1 kPa.

Preferred Embodiment 4

Figure 9:
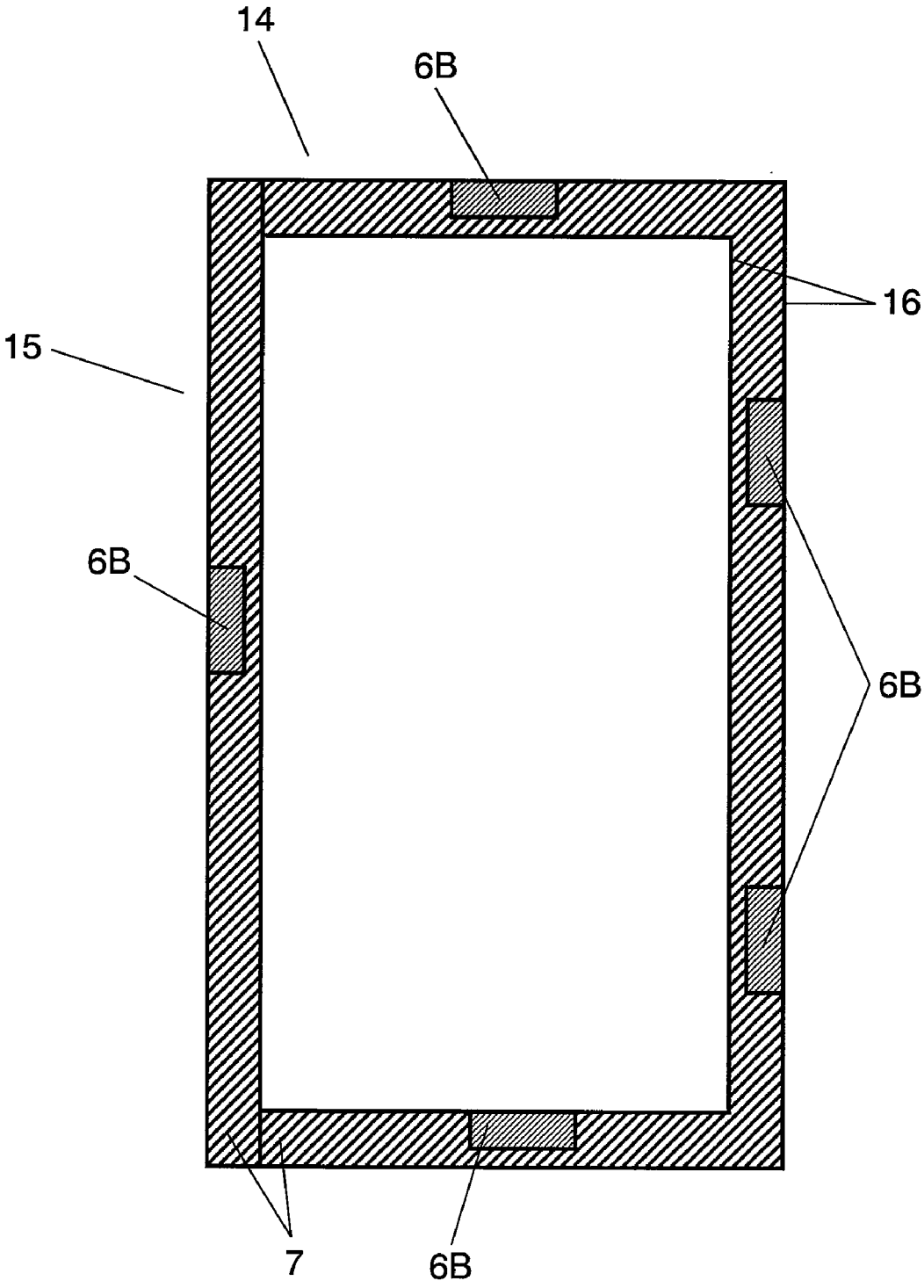
FIG. 9 is a schematic sectional view of an example of thermal insulator in preferred embodiment 4 of the invention.

FIG. 9 is a schematic sectional view of an embodiment of thermal insulator in preferred embodiment 4 of the invention. FIG. 9 shows thermal insulators 14, 15, and box 16. The adsorbent 6B and core material 7 are same as embodiment 2 (FIG. 5) of preferred embodiment 2.

The thermal insulator 14 is a box 16 having a hollow inside space formed by processing a resin material. The thermal insulator 15 is formed as a door.

The resin material may be a laminated material of metal film and resin material, such as resin material-metal film-resin material.

In preferred embodiment 4, the thermal insulators 14, 15 formed in the box 16 laminating metal film and resin material include an adsorbent 6B capable of adsorbing gas, a core material 7 of porous substance embedding the adsorbent 6B, and the box 16 containing metal of resin material laminating a metal film formed as a gas barrier enveloping member for covering the adsorbent 6B and core material 7. The core material 7 is a permeable structure or assembly, and is formed as a porous substance in a wider sense of meaning.

The core material 7 made of porous substance is preferably composed of fiber, powder, foamed resin, thin film laminate, or their mixture. In such core material 7, the effect is doubled by using a fibrous core material likely to be worsened in heat conductivity by gas, and a gas adsorbing substance.

When forming the thermal insulators 14, 15, the core material 7 of inorganic fibrous assembly and the adsorbent 6B were disposed inside the box 16, and the box 16 was evacuated and closed.

In such thermal insulator 14, the time until the internal pressure reaches 50 Pa was, as compared with the time to reach 50 Pa by evacuating by the vacuum pump alone, set so that the exhaust time by vacuum pump may be ⅕ or less. Later, the thermal insulator was closed, and automatically evacuated by the gas adsorbing substance until the internal pressure became 50 Pa, and it has been confirmed that the production efficiency can be enhanced.

Preferred Embodiment 5

Figure 10:
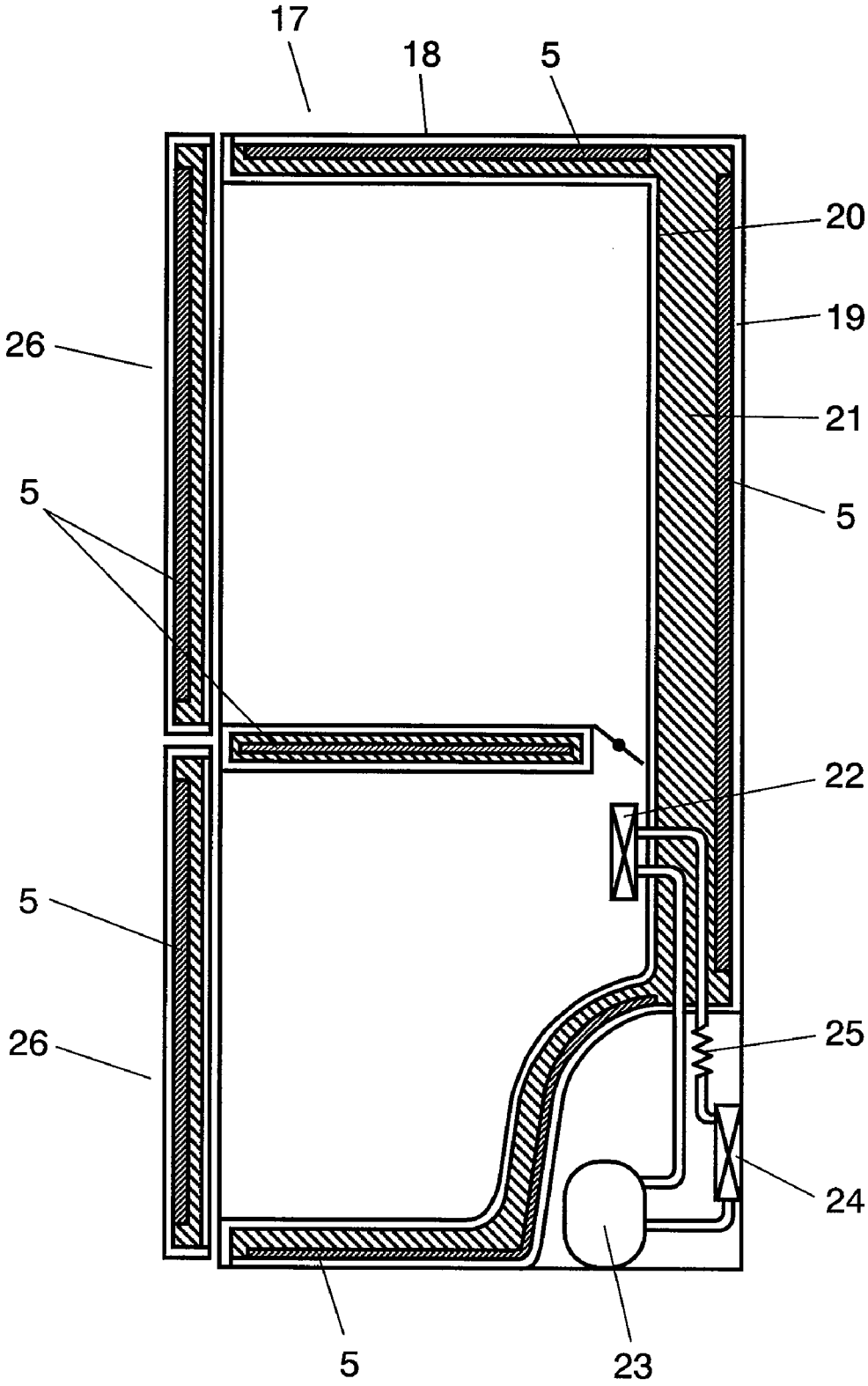
FIG. 10 is a sectional view of an example of refrigerator in preferred embodiment 5 of the invention.

FIG. 10 is a sectional view of refrigerator in preferred embodiment 5 of the invention.

In FIG. 10, a refrigerator 17 includes an insulated box 18 using the thermal insulator 5 of the same structure as shown in preferred embodiment 2 as the thermal insulator.

The insulated box 18 is a box consisting of an outer box 19 of iron plates, and an inner box 20 of plastic material, in which the thermal insulator 5 is disposed at the outer box 19 side, and the space other than the thermal insulator 5 is filled and packed with rigid urethane foam 21.

An evaporator 22 is disposed inside the refrigerator 17, and a compressor 23, a condenser 24, and a capillary tube 25 are connected in an annular profile to form a refrigeration cycle.

The refrigerator 17 has a door 26, and the thermal insulator 5 is disposed inside of the door 26, and the space other than the thermal insulator 5 is filled and packed with rigid urethane foam 21.

At this time, the thermal insulator 5 may be disposed so that the adsorbent 6 in the thermal insulator 5 may be disposed near the compressor 23 or near a radiant heater (not shown) installed in the refrigerator. In this case, since the adsorbent 6 is disposed near the compressor 23 or near the radiant heater for defrosting, the activity of the adsorbent 6 is enhanced by the heat from the compressor 23 or radiant heater.

In this refrigerator 17, power consumption was measured, and it was 30% lower than in the refrigerator not provided with thermal insulator 5, and enhancement of adiabatic effect was confirmed.

The thermal insulator of the invention can be used in refrigerating apparatus, cool and warm apparatus, cold storage vehicle, and refrigerator utilizing electronic cooling. It is also usable in automatic vending machine, and cool and warm devices using warm and cool heat up to high temperature range. The application also includes gas appliance, heat reserve or cold reserve container, cooler box, and other devices not requiring power.

Further, the thermal insulator of the invention can be further applied in personal computer, jar pot, rice cooker, and automotive engine in hot insulating, heat reserving and enveloping members, and in a higher temperature region for the purposes of hot insulation, heat reserving, and adiabatic use.

When the thermal insulator of the invention is used in refrigerating and freezing apparatuses, the gas adsorbing substances may be disposed near the compressor or defrosting heater.

Not limited to thermal insulator, the substance may be used as structure for reducing pressure, or removing nitrogen or oxygen. Kept in evacuated state, for embodiment, it may be used as display for rejecting specific substance, such as PDP, SED, organic EL, CRT, etc.

INDUSTRIAL APPLICABILITY

As described herein, the thermal insulator of the invention can adsorb the gas in the thermal insulator, especially the gas low in activity, and hence contributes to enhancement of production efficiency and enhancement of adiabatic performance, and an excellent adiabatic performance can be expressed. In particular, it can be applied in freezer, refrigerator, refrigerating machine, warming and cooling device, and other adiabatic purposes for protecting the object from heat or coldness, and its industrial application is outstanding and wide.

The invention claimed is:

1. A thermal insulator comprising an enveloping member, and an adsorbent positioned to adsorb gas within the enveloping member, wherein the adsorbent contains a mechanically alloyed mixture of Li metal and a solid matter, the solid matter comprising at least one substance selected from the group consisting of Si, B, diamond, $SiO_2$, SiC, cubic BN, $Al_2O_3$, MgO, and $TiO_2$.

2. The thermal insulator of claim 1, wherein at least part of the Li metal is 1 mm or less in particle size.

3. The thermal insulator of claim 1, wherein the Li metal and at least part of the solid matter are compatible.

4. The thermal insulator of claim 1, wherein the adsorbent further contains at least one oxide is selected from the group consisting of $Al_2O_3$, MgO, $SiO_2$ and $TiO_2$.

5. The thermal insulator of claim 1, wherein an adsorbent capable of adsorbing moisture or oxygen is provided aside from the adsorbent.

6. The thermal insulator of claim 5, wherein the adsorbent is a formed adsorbent wherein at least one side of the formed adsorbent is covered with the adsorbent capable of adsorbing moisture or oxygen.

7. The thermal insulator of claim 1, wherein a core material is further provided in the space covered with the enveloping member.

8. The thermal insulator of claim 1, wherein the enveloping member is a box containing metal.

9. A thermal insulator comprising an adsorbent capable of adsorbing gas, and a gas barrier enveloping member fix covering the adsorbent, wherein the adsorbent is a gas adsorbing alloy composed of at least two metals not forming at least intermetallic compound mutually, and the enthalpy of the mixture of the two metals is greater than 0, wherein the at least two metals include a first metal which is Li metal and a second metal selected from the group consisting of Cu metal, Fe metal, Ti metal and V metal, wherein: the adsorbent comprises a mechanically alloyed metal mixture, and the enveloping member comprises a film selected from the group consisting of plastic films, metal evaporated plastic films, inorganic material evaporated plastic films, oxide evaporated plastic films, carbon evaporated plastic films, laminate plastic films laminated with a metal foil and combinations thereof.

10. The thermal insulator of claim 9, wherein the first and second metals of the gas adsorbing alloy are compatible at least in part.

11. The thermal insulator of claim 9, wherein an adsorbent capable of adsorbing moisture or oxygen aside from the gas adsorbing alloy is provided, together with the gas adsorbing alloy.

12. The thermal insulator of claim 11, wherein the gas adsorbing alloy is a formed gas adsorbing alloy wherein at least one side of the formed gas adsorbing alloy is covered with the adsorbent capable of adsorbing moisture or oxygen.

13. The thermal insulator of claim 9, wherein a core material made of porous substance is provided in the space covered with the enveloping member, aside from the adsorbent capable of adsorbing gas.

14. The thermal insulator of claim 9, wherein the enveloping member is a box containing metal.

15. A thermal insulator comprising an enveloping member about a gas adsorbing substance capable of adsorbing at least nitrogen or oxygen at 25° C. under atmospheric pressure; and a gas adsorbing alloy inside the enveloping member and composed of at least two metals not forming at least intermetallic compound mutually, and the enthalpy of the mixture of the two metals is greater than 0, wherein the at least two metals include a first metal which is Li metal and a second metal selected from the group consisting of Cu metal, Fe metal, Ti metal, and V metal.

* * * * *